United States Patent [19]

Mewissen

[11] Patent Number: 4,902,876

[45] Date of Patent: Feb. 20, 1990

[54] ELECTRICAL COOKING APPARATUS

[75] Inventor: Jan A. C. Mewissen, Eindhoven, Netherlands

[73] Assignee: U.S. Philips Corp., New York, N.Y.

[21] Appl. No.: 253,293

[22] Filed: Oct. 5, 1988

[30] Foreign Application Priority Data

Oct. 21, 1987 [NL] Netherlands ..... 8702506

[51] Int. Cl.[4] ..... H05B 3/74

[52] U.S. Cl. ..... 219/464; 219/465

[58] Field of Search ..... 219/464, 465, 461, 462, 219/354, 377

[56] References Cited

U.S. PATENT DOCUMENTS

| | | | |
|---|---|---|---|
| 3,407,285 | 10/1968 | Jacobs | 219/464 |
| 3,813,514 | 5/1974 | Canty | 219/354 |
| 4,057,670 | 11/1977 | Scheidler | 219/464 |
| 4,101,759 | 7/1978 | Anthony | 219/354 |

FOREIGN PATENT DOCUMENTS

| | | | |
|---|---|---|---|
| 2506931 | 9/1976 | Fed. Rep. of Germany | 219/464 |
| 2719706 | 11/1978 | Fed. Rep. of Germany . | |
| 3503576 | 8/1986 | Fed. Rep. of Germany | 219/464 |
| 2132060 | 6/1984 | United Kingdom | 219/464 |

*Primary Examiner*—Teresa J. Walberg

*Attorney, Agent, or Firm*—Ernestine C. Bartlett

[57] ABSTRACT

The electrical cooking apparatus has a hot plate (10), under which an electrical cooking unit (1) is arranged, which is provided with openings (5) for receiving the ends of the glass envelope (20) of an electric filament (21). The hot plate (10) is light-scattering at least in a region (11) laterally of the cooking unit (1). Thus, it is avoided that elements under the hot plate (10) outside of the cooking unit (1) are visible, while it is nevertheless achieved that it can be observed whether the cooking unit (1) is in operation and the level of power consumed by it.

3 Claims, 1 Drawing Sheet

ELECTRICAL COOKING APPARATUS

FIELD OF THE INVENTION

The invention relates to an electrical cooking apparatus comprising an electrical cooking unit provided with a housing with a base wall and side walls placed thereon, which are provided with openings for receiving a respective end of a glass envelope of an electric filament and a hot plate of material pervious to IR radiation, opposite to which the electrical cooking unit is arranged so that its base wall is remote from the hot plate, which hot plate has at least laterally of the cooking unit means for influencing its light transmission.

BACKGROUND OF THE INVENTION

Such a cooking apparatus is known from German Patent DE No. 35 03 576 C2.

For the stability of the ends of the glass envelope of an electric filament used in an electrical cooking apparatus as a source of IR radiation, it is necessary that those ends, at which the glass envelope is sealed onto current supply conductors to the filament, have a comparatively low temperature. The housing of the cooking unit therefore has openings, which are adapted to receive a respective end of the envelope.

However, in addition to producing IR radiation, the incandescent filament also produces a comparatively large quantity of light. A disadvantage of having the openings in the housing of the cooking unit, which receive the ends of the glass envelope, is that light emanates from the housing through these openings. This light causes disturbing light effects through the hot plate and moreover renders visible electrical and constructional parts, such as electrical cables.

According to the aforementioned German Patent Specification, this disadvantage is obviated in that a heat-resistant flexible light-screening first layer is provided on the side of the hot plate facing the cooking unit in a zone around the cooking unit and in that this layer and the remaining surface of the hot plate laterally of the cooking unit are covered by a heat-resistant opaque second layer. The said Patent Specification itself indicates extensively how stringent are the requirements which must be imposed on such means for influencing the light transmission of the hot plate.

SUMMARY OF THE INVENTION

The invention has for its object to provide an electrical cooking apparatus having very simple means for preventing disturbing emission of light through the hot plate.

According to the invention, this object is achieved in an electrical cooking apparatus of the kind mentioned in the opening paragraph in that at least at one surface of the hot plate is light-scattering.

The measure according to the invention not only can be readily realized, but also has a very attractive advantage.

The known cooking apparatus according to the aforementioned German Patent Specification has the disadvantage that, when a pan is on the cooking position, the apparatus it is not readily observable whether the apparatus is switched on except by observing the position of the power regulating button. It is even less readily observable whether the apparatus is adjusted to a high or to a low power setting. The fact that these data are nevertheless of major importance appears, for example, from DE No. 27 19 706 C2, according to which a series of LED's are used to enable a user to visualize the power consumption of an electrical apparatus.

In the cooking apparatus according to the invention, the hot plate is illuminated during operation laterally of the cooking unit with a diffuse radiation having a brightness which is proportional to the power consumption of the cooking unit. As a result, it is clearly indicated that the cooking unit is in operation, while at the same time, an indication of the power consumption is obtained. On the other hand, the object of the invention is achieved in that the hot plate is not transparent and does not provide a (clear) image of the electrical or mechanical components present under the hot plate laterally of the cooking unit.

The hot plate can be made light-scattering due to the fact that a surface is roughened, for example by etching or by sand or grit blasting. It is also possible that a surface is made light-scattering due to deposition of material, for example of silicate particles.

The hot plate may also be light-scattering at the area of the cooking position, that is to say at a position opposite the cooking unit. This has the advantage that no dazzling occurs when a pan is taken from the hot plate during operation. On the other hand, a difference in light-scattering by the hot plate in the cooking position and outside this position can be used as a clear limitation of the cooking position.

In order to facilitate cleaning of the cooking apparatus, the outer surface of the hot plate will generally be fairly smooth.

In case the quantity of light emanating through the hot plate is excessively large, an electrical filament having a glass envelope of, for example, red color can be used in the cooking apparatus. For this purpose for example, use may be made of quartz glass envelopes having, for example, a red coating or of envelopes consisting of colored glass, for example colored quartz glass. In order to obtain a red color, for example oxides of iron, nickel and aluminum be diffused into said glass. Another possibility is to color the hot plate itself or to provide it with a colored layer, which is applied, for example, by vapor deposition.

BRIEF DESCRIPTION OF THE DRAWING

An embodiment of an electrical cooking apparatus according to the invention is shown in the drawing. In the drawing.

DETAILED DESCRIPTION OF THE PREFERRED EMBODIMENTS

Figure 1:
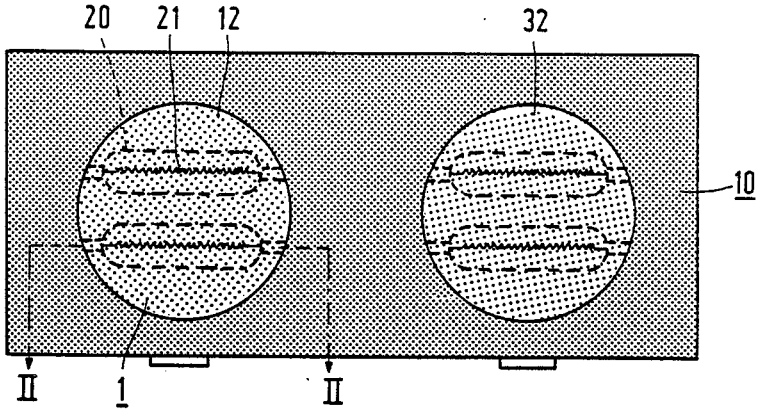
FIG. 1 is a plan view of an electrical cooking apparatus.
Figure 2:
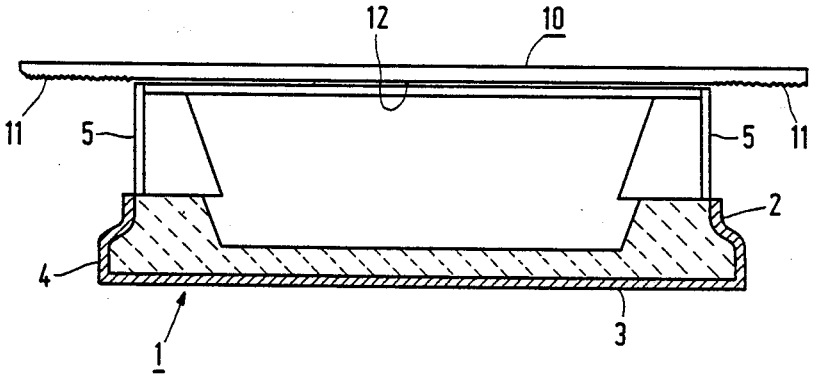
FIG. 2 is a sectional view taken on the line II—II.

In the drawing, the electrical cooking apparatus has an electrical cooking unit 1, which is provided with a housing 2 (FIG. 2) having a base wall 3 and side walls 4 placed thereon. The side walls 4 have openings 5 for receiving a respective end of a glass envelope 20 (FIG. 1) of an electric filament 21.

The cooking apparatus has a hot plate 10 of material pervious to IR radiation, for example of glass ceramic, opposite to which the electrical cooking unit 1 is arranged so that its base wall 3 is remote from the hot plate 10.

The hot plate 10 has at least laterally of the cooking unit 1 means for influencing its light transmission. For this purpose, the hot plate 10 is made light-scattering at least at one surface. In the drawing, the hot plate 10 has been made light-scattering at its surface facing the cooking unit 1, in the region 11 around the cooking unit by roughening said region 11.

Light emanating from the cooking unit 1 through the openings 5 would illuminate constructional elements and cabling in the cooking apparatus and make the latter visible via the hot plate 10 in the absence of the step according to the invention. Due to the step according to the invention, the hot plate 10 is translucent at least outside the cooking position 12. As a result, elements of constructional or electrical nature present outside the cooking position 12 under the hot plate 10 can no longer be observed. On the other hand, due to the fact that the hot plate 10 is still translucent, it can be observed outside the cooking position whether the cooking position 12 is in operation, even if this cooking position is covered by a pan. Said pan is then surrounded by a diffusely illuminated zone, whose brightness is an indication of the power consumed by the relevant cooking unit. The possibility of dazzling upon removal of a pan from a cooking position can be reduced by rendering the hot plate 10 light-scattering also at the area of the cooking position 12. The cooking apparatus shown also has a second cooking position 32.

What is claimed is:

1. An electrical cooking apparatus comprising an electrical cooking unit provided with a housing with a base wall and side walls placed thereon, which are provided with openings for receiving a respective end of a glass envelope of an electric filament, and a hot plate of material pervious to IR radiation, which is arranged opposite the electrical cooking unit so that its base wall is remote from the hot plate, which hot plate has at least laterally of the cooking unit means for influencing its light transmission, wherein at least one surface of the hot plate is light-scattering and wherein the hot plate is illuminated during operation laterally of the cooking unit with a diffuse radiation having a brightness which is proportioned to the power consumption of the cooking unit.

2. An electrical cooking apparatus as claimed in claim 1, wherein the hot plate is also light-scattering at a position opposite the cooking unit.

3. An electrical cooking apparatus as claimed in claim 2, wherein the hot plate is light-scattering and translucent laterally of the cooking unit and is also light-scattering at the cooking unit position.

* * * * *